United States Patent [19]

Bianchi et al.

[11] 4,166,780

[45] Sep. 4, 1979

[54] NOVEL ELECTROLYTIC PROCESS

[75] Inventors: Giuseppe Bianchi; Oronzio De Nora, both of Milan, Italy; Placido M. Spaziante, Lugano, Switzerland

[73] Assignee: Oronzio de Nora Impianti Elettrochimici S.p.A., Milan, Italy

[21] Appl. No.: 906,656

[22] Filed: May 16, 1978

[30] Foreign Application Priority Data

Jan. 24, 1978 [IT] Italy ..... 19560 A/78

[51] Int. Cl.[2] ..... C25B 1/16; C25B 1/26

[52] U.S. Cl. ..... 204/99

[58] Field of Search ..... 204/99, 140, 141.5

[56] References Cited

U.S. PATENT DOCUMENTS

| | | | |
|---|---|---|---|
| 3,364,128 | 1/1968 | Williston et al. | 204/140 |
| 3,562,123 | 2/1971 | Carlin et al. | 204/99 |

*Primary Examiner*—R. L. Andrews

*Attorney, Agent, or Firm*—Hammond & Littell

[57] ABSTRACT

An improved process for the production of halogens and alkali metal hydroxide by electrolysis of aqueous solution of alkali metal halides in a flowing mercury electrolysis cell wherein the salt solutions do not have to purified and to novel amalgam denuders and a mercury electrolytic cell plant without a salt purification step.

8 Claims, 6 Drawing Figures

NOVEL ELECTROLYTIC PROCESS

STATE OF THE ART

Electrolysis of aqueous sodium chloride solutions to produce chlorine and sodium hydroxide by the so-called mercury amalgam process is still widely used industrially as it presents several advantages over other existing processes, for example, those utilizing diaphragm or membrane cells. At present, in all the commercially known plants, the amalgam leaving the electrolysis cell is decomposed in a reactor provided with a catalytic filling with water and hydrogen and caustic soda produced by the decomposition process are recovered and mercury is recycled to the cell. The process is presently very reliable and highly perfected and especially with the utilization of recently developed dimensionally stable anodes based on valve metals provided with electrocatalytic coatings in place of the conventional graphite anodes.

One of the main factors affecting reliable operation and safety of the mercury amalgam process is the purity of the brine introduced into the cell as the level of impurities that can be tolerated in the process is very low. Quantities varying from 0.3 to 0.01% of impurities such as calcium, magnesium and iron are usually present in salt while other heavy metals like Cr, V, Mo, Mn are often present in a concentration of about 0.01 ppm. These impurities must be carefully removed from the brine since quantities higher than 0.01 ppm in the brine can cause hydrogen to evolve at the mercury cathode after an extended period of time and the $Cl_2$-$H_2$ mixture formed thereby can explode with disastrous effects.

To avoid this problem, the brine cycle used in mercury cell plants comprises the following steps: (1) dechlorination; (2) saturation of the depleted brine with salt; (3) chemical and physical purifications; and (4) adjustment of the pH to 4.5 to 5.5 before feeding the brine to the cell. While this purification system permits a relatively safe operation unaffected by sudden catastrophic phenomena, frequent periodic cleaning of the cell and purification of the introduced mercury by distillation are required, or impurities introduced in the system with the brine would accumulate in the mercury in the long run far beyond the maximum tolerable limit.

The most critical impurities detectable in mercury after a more or less prolonged operation in mercury cells are classified according to the consequences they involve and comprise for example: (a) V, Cr, Mn, Fe, Ni, Co, Cu, Mo, Pb, As, Sb, Se, Te, Ga and Ti as metals or oxides, hydroxides or mixed oxides which give rise to hydrogen discharge on the amalgam and to the formation of amalgam foam (called mercury butter) and (b) $Ca(OH)_2$, $Mg(OH)_2$, $Na(OH)_2$, $Sr(OH)_2$, $Be(OH)_2$ and $Al(OH)_3$ which catalyze hydrogen discharge and cause amalgam pulverization.

When impurities accumulate in the mercury circulating in the cell, the electrolysis process is adverserly affected by the following phenomena: (i) mercury butter formation with a consequent increase of frequency of short-circuits in the cell and rapid inactivation of the anodes, (ii) hydrogen evolution, (iii) decrease of wettability between the mercury and the cell bottom with frequent breaking of the mercury liquid stream and consequent corrosion of the exposed cell bottom, (iv) mercury amalgam decomposition in the cell, (v) mercury oxide formation and (vi) cell voltage increase, faraday efficiency decrease and current distribution unbalances in the various longitudinal and transversal sections of the cell.

OBJECTS OF THE INVENTION

It is an object of the present invention to provide a new and improved process for maintaining the level of impurities contained in the mercury circulating in the cell within limits that do not affect the electrolytic process and avoids interruptions of the cell operation.

It is a further object of the invention to provide for a new and improved process wherein unpurified salt is utilized as raw material; and wherein the expensive dechlorination and brine purification plants are no longer necessary.

It is another object of the invention to provide a process for continuously removing impurities introduced together with unpurified salt from the mercury circulating in the cell whereby an equilibrium is achieved and the level of impurities can be maintained within the admissible limits.

It is an additional object of the invention to provide a novel denuder for decomposing amalgam and removing impurities from mercury.

These and other objects and advantages of the invention will become obvious from the following detailed description.

THE INVENTION

The improved process of the invention for producing a halogen and an alkali metal hydroxide solution by electrolysis of an aqueous solution of an alkali metal halide in a mercury cathode electrolysis cell comprises subjecting the amalgam leaving the electrolysis to decomposition to form mercury and an alkali metal hydroxide solution and subjecting the mercury to anodic polarization in an electrolyte with a counter-electrode maintained at a sufficiently negative potential to remove from the mercury at least a portion of metal impurities contained therein and recycling the purified mercury to the electrolysis cell. The metal impurities in the mercury are preferentially anodically dissolved in the electrolyte so that the level of impurities in the mercury will be held below the levels which would adversely effect the electrolytic reaction taking place in the electrolysis cell.

The decomposition of the alkali metal-mercury amalgam leaving the electrolysis cell may be carried out in a convertional denuder wherein the amalgam is contacted with a catalytic material such as graphite in the presence of water to form mercury, hydrogen and an alkali metal hydroxide solution. The alkali metal must be substantially completely removed from the mercury before the electrolytic purification to avoid it being anodically dissolved before or in place of the metal impurities when mercury flows through the electrolytic purification stage. Sodium dissolution, besides involving a loss of caustic sodium production due to sodium being discharged together with the purification electrolyte, also entails a useless consumption of electricity which partially or completely reduces the advantages of the present invention. Often this condition is not present in conventional plants wherein mercury leaving the decomposition stage still contains from 0.001 to 0.005% of sodium.

The mercury electrolytic purification process may conveniently be carried out in the mercury inlet box of the electrolysis cell itself where the mercury pool has a sufficient large surface area. In this case, an horizontal plane electrode made of iron, nickel or graphite, and preferably foraminous, is placed at a distance of a few millimeters up to 1 or more centimeters from the mercury surface and is cathodically polarized by a current supply floating with respect to the mercury potential.

The electrolyte in the inlet box may be either alkaline or acidic, but is preferably acidic. Preferably, water or a NaCl solution acidified with hydrochloric acid is circulated through the cell inlet box and the pH is kept between 1 and 3.5. A large amount of impurities are removed from mercury and are together with the electrolyte removed from the inlet box and the electrolyte may be stripped of the metal values and recirculated.

The mercury polarization is kept between 0.1 and 1 V (NHE), preferably within 0.1 and 0.5 V (NHE), by an adequate control of the cathodic polarization impressed on the counter-electrode depending upon the cell parameters such as distance of mercury from the counter-electrode surface, the electrolyte conductivity, the purity of the salt, the current density, etc. A substantial anodic dissolution of the metal impurities contained in the mercury is achieved by operating within the above mentioned limits. Moreover, the anodic dissolution of the mercury itself is minimal because mercury is much nobler than the pollutant metal impurities. Most of the mercury which may have been anodically dissolved is cathodically reduced on the counter-electrode and precipitates as metallic mercury in the mercury pool.

Oxidized mercury still present in the effluent electrolyte represents only a minimum amount with respect to the mercury present in the caustic, hydrogen and headbox washing waters effluent from the electrolysis section of the plant and likewise is recoverable through the available mercury stripping systems. The decomposed metals are preferably removed from the electrolyte and the purified electrolyte is recycled. It has been found that a mercury surface area opposed to the counter-electrode in a ratio of 1/1000 with respect to the area of the electrolysis cell mercury surface is sufficient although this may vary from 1/100 to 1/10,000 depending upon the specific condition.

In a preferred embodiment of the process of the invention, the sodium content in mercury is practically brought to zero by a complete decomposition of the amalgam leaving the electrolysis cell, the decomposition being effected, at least partially, electrolytically. This treatment can be conveniently carried out in two alternative ways.

In the first alternative, the amalgam leaving the electrolysis cell is percolated through a series of porous plates made of a conductive material, the said plates being electrically insulated with respect to the adjacent plates and having impressed thereon a voltage of about 0.2–0.4 V (lower than the water decomposition voltage to avoid eventual oxygen evolution) between every plate and the plates adjacent to it in the series and circulating water for diluting the sodium hydroxide produced counter-current to the amalgam stream. The electrolytic denuder is electrically insulated with respect to the incoming amalgam and to the exiting mercury by breaking the liquid stream during the mercury leakage through the porous plates, preferably made of inert and non-conductive material, placed one at the inlet and one at the outlet of the denuder, respectively. The amalgam percolating through the denuder is anodically polarized by contact with the porous plates connected to the positive pole of the electric current source and sodium is readily released forming the sodium hydroxide with consequent hydrogen evolution. Therefore, the mercury collected at the denuder base plate is essentially free from sodium content. The porous plates may advantageously consist of graphite either in the solid form or as a static porous bed of different grain sizes.

In the second alternative, the process can be easily integrated into the existing commercial plants which utilize denuders provided with graphite or other material fillings. In this alternative, mercury leaving the denuder is subjected to further amalgam decomposition in order to remove the residual sodium by subjecting an adequate portion of the mercury surface to anodic polarization with respect to a counter-electrode made from steel, nickel, graphite or other suitable conductive materials connected to a floating current supply with the caustic solution acting as the electrolyte. The final decomposition stage can be easily realized at the bottom of a conventional denuder by inserting a counter-electrode placed at a distance varying from some millimeters to 1 or 2 cm from the surface of the mercury pool which collects on the denuder bottom with the electrode being cathodically polarized with respect to the mercury.

Therefore, according to a preferred embodiment of the invention, mercury is continuously subjected to two anodic polarization stages, a first stage carried out in an alkaline environment to remove completely the sodium content and to partially remove metal impurities such as potassium, lithium, barium, aluminum, etc., which can be easily anodically dissolved in an alkaline environment, and a second stage carried out preferably in an acid environment for removing impurities such as oxides, hydroxides and heavy metal oxysalts.

One of the advantages of the invention is the elimination of the dechlorination treatment of the brine which can be sent to the cell without being subjected to any purification treatment. The diluted chlorine, which poses a difficult problem for its disposal, is no longer produced. According to the present invention, every cell may be provided with an autonomous system of saturation and feeding of the brine. The system is very easy to realized. In this way, the entire centralized system for brine treating, distributing and recycling is no longer necessary resulting in a considerable saving.

According to another embodiment of the invention, it is also possible to feed the salt directly to the cell onto the mesh anodes. The turbulence formed by the gaseous chlorine evolution is utilized to effect salt dissolution and to avoid channeling phenomena.

The process of the invention has been mainly described by referring to sodium chloride electrolysis due to its great industrial importance but it is obvious that other alkali metal halides such as potassium chloride may be considered as well.

Referring now to the drawings:

FIGS. 1 to 3 schematically illustrate the flow of mercury in three different embodiments of the invention.

Figure 1:
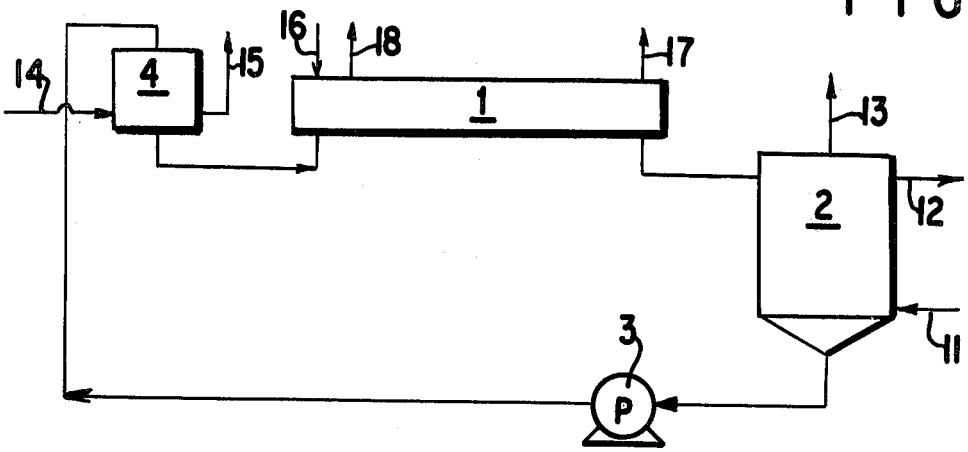

FIG. 1 illustrates the mercury circuit in a chlorine plant wherein brine is electrolyzed in mercury electrolysis cell 1. The amalgam leaving the cell 1 is introduced at the upper portion of denuder 2 which is filled with a static porous bed of catalytic material such as graphite granules. Water is introduced by line 11 into the lower portion of denuder 2 and flows counter current to the amalgam during which sodium is stripped from the amalgam to form sodium hydroxide and hydrogen is evolved. The hydrogen is removed through outlet 13 and the sodium hydroxide solution is removed through outlet 12. The mercury from the bottom of denuder 2 is conducted by pump 3 to the electrolytic purification cell 4 and then back to electrolysis cell 1 which is provided also with brine inlet 16, brine discharge 17 and chlorine outlet 18. Electrolyte is added to purification cell 4 by line 14 and is discharged through outlet 15.

Figure 2:
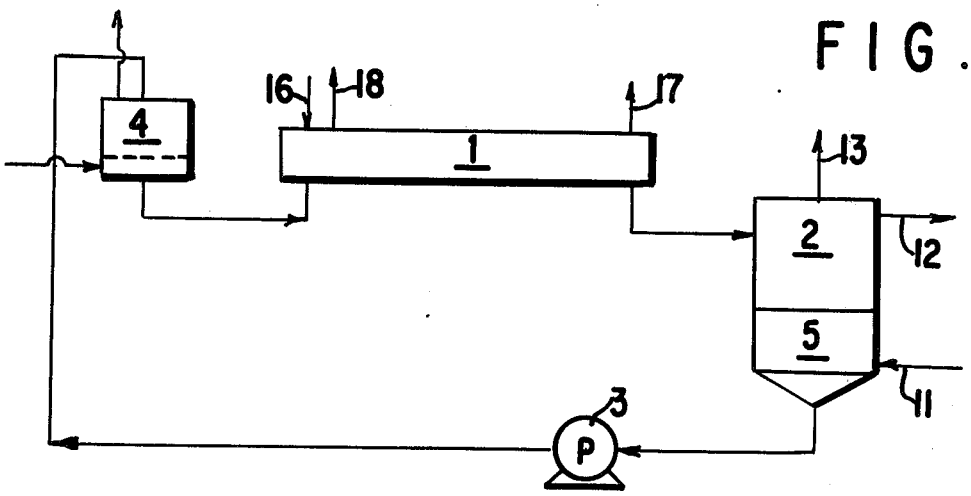

FIG. 2 illustrates a preferred embodiment of the process of the invention wherein the mercury flow is the same as in FIG. 1 with the addition of an electrolytic decomposition stage 5 provided at the bottom of denuder 2 to eliminate any residual sodium in the mercury before the electrolytic purification step of cell 4. The stage 5 is illustrated further in FIG. 5 which is described infra.

Figure 3:
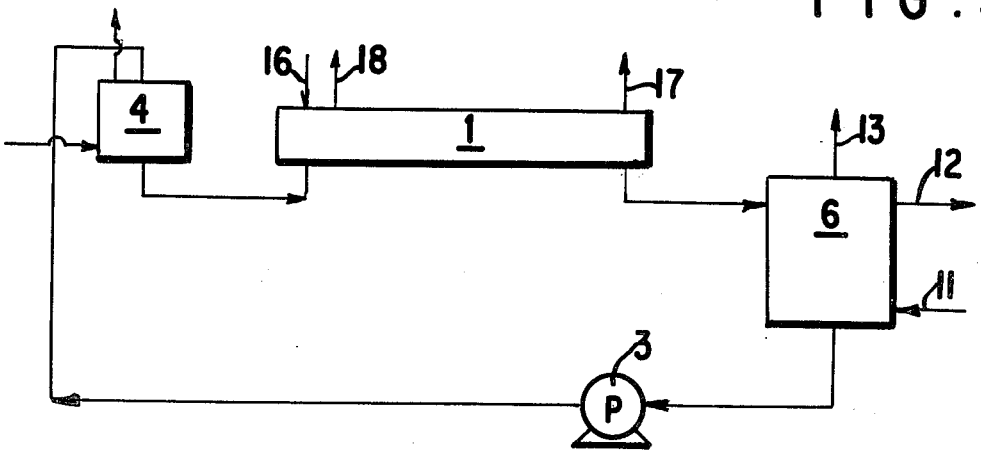
Figure 6:
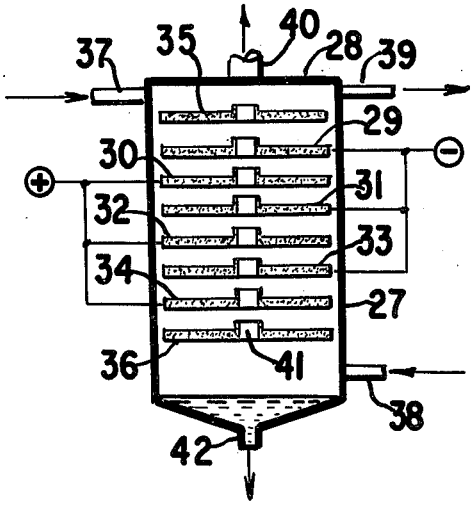
FIG. 6 is a schematic cross-sectional view of an electrolytic amalgam denuder of the invention to completely remove sodium from the amalgam.

FIG. 3 illustrates another embodiment of the process of the invention wherein the mercury flow is as in FIG. 1 but the denuder 2 is replaced with an electrolytic amalgam denuder 6 which is illustrated in greater detail in FIG. 6 to remove the sodium from the amalgam.

Figure 4:
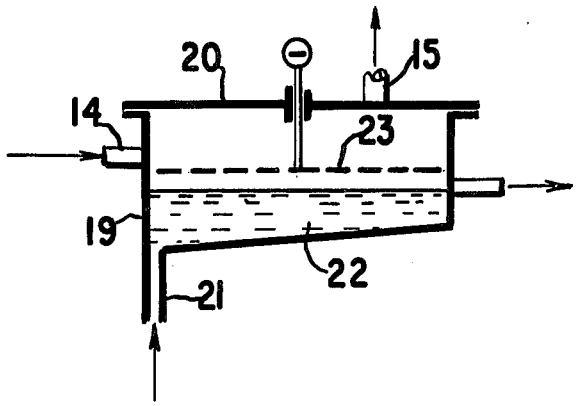
FIG. 4 is a schematic view of the electrolytic mercury purification cell of FIGS. 1 to 3 indicated therein as 4.

In the electrolytic purification cell illustrated in FIG. 4, the cell consists of a container 19 provided with a cover 20, both made of a corrosion resistant material such as rubber-lined steel and as noted above, the electrolyte is introduced through inlet 14 and removed by outlet 15. Mercury is introduced at the bottom through inlet 21 to maintain a layer 22 of mercury on the cell bottom. Counter electrode 23 made of steel, nickel, graphite or other suitable material is placed at a certain distance from the mercury and a direct current by means not shown is placed on the mercury-counter electrode with the counter-electrode being negatively polarized with respect to the mercury by a floating electric current supply whose positive pole is preferably connected to the bottom of container 19. Any mercury deposited on counter-electrode 23 will fall back to the pool of mercury 22 on the container bottom.

Figure 5:
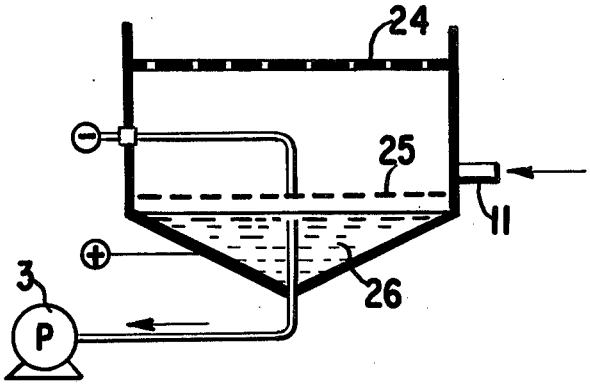
FIG. 5 is a schematic partial cross-sectional view of the bottom of a denuder provided with an electrolytic final decomposition stage of FIG. 2.

In FIG. 5, the lower portion of denuder 5 is provided with an electrolytic decomposition zone below divider plate 24 in which a pool 26 of mercury collects in the denuder bottom. A counter electrode 25 made of graphite, steel, nickel or other suitable, electrically conductive material is placed a certain distance from mercury pool 26 and the electrode 25 is cathodically polarized with respect to pool 26 by a floating direct electric current supply (not shown) whose positive pole is directly connected to pool 26. The electrolyte for the decomposition stage is the water introduced by line 11 to form sodium hydroxide solution during its passage through the denuder.

In FIG. 6, the amalgam electrolytic denuder consists of a container 27 provided with a cover 28, both preferably made of an inert, electrically non-conductive material or steel coated on its interior surfaces with an inert, electrically non-conductive material. The container 27 is provided with a series of horizontal porous plates with each plate being electrically insulated from the two adjacent plates. Plates 29, 31 and 33 made of electrically conductive, amalgam resistant material such as graphite are connected to the negative pole of a floating direct current electrical supply means (not shown) and plates 30, 32 and 34, also made of electrically conductive, amalgam resistant material such as graphite are connected to the positive pole of said electrical supply means.

Top plate 35 and bottom plate 36 are made of graphite or other porous material which need not be electrically conductive and the plates break the liquid stream of incoming amalgam and exiting mercury, respectively, to effect electrical insulation of the denuder from the mercury potential in the electrolysis cell 1. The amalgam from the cell 1 is introduced by line 37 into the top of the denuder and percolates down through the series of porous plates which interrupt the stream at every pass from one plate to the lower plate. As the amalgam contacts the postively polarized plates, the sodium is readily released for anodic dissolution and gives rise to hydrogen evolution and sodium hydroxide formation.

Each of the porous plates are provided with a hole 41, preferably coaxial, to form a type of chimney for hydrogen passage and a suitable weir is provided about the upper edge of each hole 41 to prevent amalgam from falling through the holes. Water is introduced at the bottom of the denuder through line 38 and flows counter-current to the mercury and is discharged through outlet 39 while hydrogen is removed by outlet 40. The mercury collects on the denuder bottom wherein it is sent by outlet 42 to the electrolytic purification stage 4 of FIG. 3.

In the following example there are described several preferred embodiments to illustrate the invention. However, it is to be understood that the invention is not intented to be limited to the specific embodiments.

EXAMPLE 1

Reduced side tests were conducted using the mercury flow scheme of FIGS. 1 and 4 wherein the ratio of the area of the mercury surface in electrolysis cell 1 to surface in electrolytic purification cell 4 was 1,000:1 and the ratio of electrolysis current density between the said cells was 10,000:1. The electrolyte circulated in electrolytic purification cell 4 was aqueous hydrochloric acid with a constant pH of 3. The brine fed to the cell 1 through inlet 16 was not purified in any manner and contained as impurities: 0.5 to 0.01% of Fe, 0.1 to 0.05% of Ca, 0.1 to 0.05% of Mg and 0.01 to 0.005 ppm of chromium. The cell 1 was operated continuously for 6 days and the amount of impurities determined is reported in Table I. No operating deterioration in the electrolysis cell was observed and the hydrogen content in the chlorine was constant within 0.5% and the faraday efficiency varied from 96 to 97%.

The electrolysis cell 1 was then shut down and graphite counter-electrode 23 was removed from electrolytic purification cell. The cell 1 was then operated for 8 hours after which the impurities in the brine were determined. The results are reported in Table I. At the end of the 8 hours of operation, the faraday efficiency had fallen to 91% and the hydrogen content in the chlorine had increased rapidly to 5%.

TABLE I

| Impurity | PPM With electrolytic purification | PPM Without electrolytic purification |
|---|---|---|
| Fe | 2 to 20 | 100 to 700 |
| Ca | 0.1 to 2 | 10 to 200 |
| Mg | 0.05 to 1.5 | 5 to 80 |
| Cr | 0.001 to 0.01 | 0.01 to 0.02 |

The said test clearly shows that the process of the invention may be operated without salt purification for prolonged periods of time while the impurity level without the electrolytic purification quickly rises to undesirable levels resulting in increased hydrogen generation and a sharp drop in faraday efficiency.

EXAMPLE 2

The test of Example 1 was repeated except the salt was added directly to the electrolysis cell 1 onto the mesh anodes above the mercury surface and the salt slowly dissolved in the circulating electrolye. After 10 days of operation with electrolytic purification, the cell was still operating satisfactorily.

Various modifications of the process and apparatus of the invention may be made without departing from the spirit or scope thereof and it is intended to be limited only as defined in the appended claims.

We claim:

1. In a process for electrolysis of an aqueous solution of an alkali metal halide in a mercury cathode electrolysis cell to produce halogen and alkali metal hydroxide, the improvement comprising subjecting the amalgam leaving the electrolysis to decomposition by anodic polarization under alkaline conditions to form mercury and an alkali metal hydroxide solution and subjecting the mercury to anodic polarization under acidic conditions in an electrolyte with a counter-electrode maintained at a sufficiently negative potential to remove from the mercury at least a portion of metal impurities contained and recycling the purified mercury to the electrolysis cell.

2. The process of claim 1 wherein the electrolyte for the anodic polarization has a pH of 1 to 3.

3. The process of claim 1 wherein the ratio of the surface area of the mercury in the electrolysis cell and the surface area of the counter-electrode for the anodic polarization is 100 to 10,000.

4. The process of claim 1 wherein the ratio of the electrolysis current in the electrolysis cell and the anodic polarization is at least 10,000.

5. The process of claim 1 wherein the alkali metal halide is sodium chloride.

6. A process of decomposing sodium amalgam comprising subjecting sodium amalgam to decomposition by anodic polarization under alkaline conditions with water to form hydrogen and sodium hydroxide and subjecting the mercury to anodic polarization under acidic conditions in an electrolyte with a counter-electrode maintained at a sufficiently negative potential to remove from the mercury at least a portion of metal impurities contained therein.

7. The process of claim 6 wherein the pH of the electrolyte is 1 to 3.

8. The process of claim 6 wherein the mercury at the bottom of the denuder is subjected to anodic polarization in the presence of water at the bottom of the denuder to completely remove sodium.

* * * * *